United States Patent [19]

Freet

[11] Patent Number: 5,005,238

[45] Date of Patent: Apr. 9, 1991

[54] WATER BED MATTRESS

[75] Inventor: E. Thomas Freet, Alta Loma, Calif.

[73] Assignee: Nature Sleep Corporation, Rancho Cucamonga, Calif.

[21] Appl. No.: 575,190

[22] Filed: Aug. 29, 1990

[51] Int. Cl.[5] ..... A47C 27/10

[52] U.S. Cl. ..... 5/451; 5/464

[58] Field of Search ..... 5/451, 450, 455, 422, 5/449, 481, 462, 464

[56] References Cited

U.S. PATENT DOCUMENTS

| | | | |
|---|---|---|---|
| 3,585,356 | 6/1971 | Hall | 5/451 |
| 4,057,862 | 11/1977 | LaBianco | 5/451 |
| 4,109,333 | 8/1978 | Zmiarovich | 5/451 |
| 4,422,194 | 12/1983 | Viesturs et al. | 5/451 |
| 4,521,929 | 6/1985 | Keefer | 5/451 |
| 4,627,121 | 12/1986 | Winther | 5/451 |
| 4,707,872 | 11/1987 | Hessel | 5/451 |
| 4,737,998 | 4/1988 | Johnson, Sr. | 5/451 |
| 4,912,789 | 4/1990 | Maxwell | 5/451 |
| 4,947,500 | 8/1990 | Seiler | 5/455 |

*Primary Examiner*—Alexander Grosz
*Attorney, Agent, or Firm*—Christie, Parker & Hale

[57] ABSTRACT

A water bed mattress comprises a rectangular compressible plastic foam sheet containing a plurality of uniformly dispersed cylindrical cutouts across the surface area of the compressible sheet. A separate water cushion is located in each of the cutout areas. The water cushion comprises a hollow, flexible enclosure made of a cylindrical closed ended flexible plastic material. Water is contained within the interior of each flexible plastic enclosure. In one embodiment, the plastic water-filled cushion fills approximately the upper two-thirds of each cylindrical cutout, and the lower one-third portion of the cylindrical cutout is filled by a compressible plastic foam disc. A cardboard ring having an inner diameter approximately equal to the diameter of the cylindrical cutout is located on the upper surface of the rectangular compressible plastic foam sheet and concentric with the cylindrical cutouts. A plastic cylindrical cutout liner covers and is heat sealed to the cardboard ring. The cylindrical cutout liner lines the interior portion of the cylindrical cutout and acts as a retaining barrier in case of any water cushion leakage. A heat reflective tufted quilt covers, and is removable mounted to the upper surface of the compressible plastic foam sheet. Because of the uniform dispersion of the water cushions, the wave action of the mattress is contained in both latitudinal and longitudinal directions. When pressure is applied downwardly on any of the water cushions, the sides of the plastic enclosure spread outwardly into the adjacent foam pad to absorb the downward pressure.

18 Claims, 5 Drawing Sheets

WATER BED MATTRESS

FIELD OF THE INVENTION

This invention relates generally to flotation sleep systems, and more particularly, to a water bed mattress comprising a thick sheet of compressible plastic foam and an array of water coils or cushions spaced apart across the surface area of the compressible foam sheet.

BACKGROUND OF THE INVENTION

Over the past twenty years, water beds have become increasingly popular because of the therapeutic comfort they provide which is not offered in conventional spring mattresses. Original water bed mattresses consisted of a single, large, flexible bladder filled with water or other liquid and supported in a steady support frame. These water beds gained limited popularity because of many disadvantages such as wave motions and continuing oscillating responses to relatively small motions, excess of weight, which made them impossible to move, difficulty in filling and emptying, limited buoyancy adjustments, and leakage problems. When a leak would occur, it would be necessary to empty the mattress completely, patch the mattress and then refill it. In addition, the amount of water involved in such a leak could result in substantial water damage to the surroundings, and would be extremely difficult to clean up. In response to the problems of excessive wave motion and oscillations of the conventional water bed mattresses, numerous mattresses were developed which incorporated complicated baffle structures or other motion dampening systems for reducing the wave action. However, although the complicated baffle constructions diminished the problem of excessive wave motion, they did nothing to alleviate the problems of weight and leakage. In fact, the baffles tended to increase the weight of the water bed mattress as well as add to the cost and complexity of manufacturing.

Water bed mattresses have been designed in an attempt to solve the weight and leakage problems, as well as the problem of wave motion. These mattresses comprise a plurality of individual tubes supported in a cavity defined by pairs of foam panel members, or a plastic tray structure. The individual tubes do not transmit significant side forces or wave motion to the other tubes, and thus provide a steadier sleeping surface than the conventional single bladder mattress. In addition, the individual tubes can be removed from the bed for relatively easy filling and drainage, and can be filled to varying degrees to control the firmness of the mattress. When a leakage occurs, it is necessary only to repair or replace a single leaking tube, rather than to remove an entire bladder for patching. The tube configuration also reduces the weight of the mattress.

Although the tube type water bed has some advantages, it still suffers from several drawbacks. First of all, although the tubes do not transmit side forces to one another, waves are still free to travel longitudinally from one end of the tube to the other. Thus, some oscillating motion is still felt. In addition, the individual tubes are designed to hold approximately fifty pounds of water. Although lighter than the conventional water beds, they still are heavier than desireable for the average consumer. Furthermore, the foam panel members or tray structure which contains the tubes allow for any leakage to spread out over the entire surface of the panel or tray. Although the amount of water involved in the leak would be less, and it is contained within the foam panel or tray, the entire bed would need to be disassembled to clean up the leak. As a further problem of the tube type mattress, the lack of fluid communication between the individual tubes produces poor heat transfer between tubes. Thus, a conventional water bed heating unit consisting of a single heating pad placed under the center of the mattress will not satisfactorily heat those tubes which are located farthest from the center. Finally, although the tube configuration allows the firmness of each side of the water bed to be varied, the firmness between the top and the bottom of the water bed cannot be controlled.

Thus, there has existed a long felt need in the art for a new and improved water bed mattress which reduces wave motion, is easy to transport and fill, minimizes leakage, and provides a means for adjusting the firmness of the bed at any point along the surface.

SUMMARY OF THE INVENTION

The present invention provides an improved water bed mattress which eliminates the problems of prior existing water bed mattresses and yet is simple and inexpensive to manufacture.

In one embodiment, the water bed mattress of the present invention includes a thick sheet of compressible plastic foam, such as polyurethane foam. The compressible foam sheet has a number of cylindrical cutouts dispersed reasonably uniformly across the surface area of the sheet. Separate water cushions are disposed in the cylindrical cutouts to form an array of water cushions spaced apart (both laterally and longitudinally) across the surface area of the compressible foam sheet. The water cushion comprises a hollow, flexible enclosure made of a cylindrical, closed ended, flexible water impervious material. Each water cushion also has a filler cap on its top, for use in filling the enclosure with water and sealing the top against leaks. A selected volume of water is contained within the interior of each flexible enclosure.

The array of water cushions provide separate spaced apart fully and contained means of water support dispersed reasonably uniformly across the surface area of the foam sheet. The foam sheet is of sufficient thickness, flexibility and density to provide a useful level of sleeping support, while the water cushions provide independent areas of water support in the plane of the compressible foam sheet. The amount of water contained in each water cushion can be independently varied, and as a result, the amount of water support can be controlled across the entire surface are of the sleeping surface.

Separate compressible foam inserts can be disposed in the cutout areas to partially fill these areas, with the remainder of the cut-out area being filled by the water cushion. This provides an additional means of firmness control.

In one embodiment, a cardboard ring slightly larger than the cylindrical cutouts is placed on the surface of the thick sheet of compressible foam at each cylindrical cutout. A flexible water impervious material, such as vinyl, is heat sealed around the cardboard ring and extends into and lines the cylindrical cutout. This lining serves as a water barrier and contains any possible leakage from the water cushion.

A tufted quilt can be used to cover the entire surface and sides of the mattress, attaching to the thick sheet of compressible plastic foam by a zipper, or other fastening means.

These and other aspects of the invention will be more fully understood by referring to the following detailed description and the accompanying drawings.

DETAILED DESCRIPTION

Figure 1:
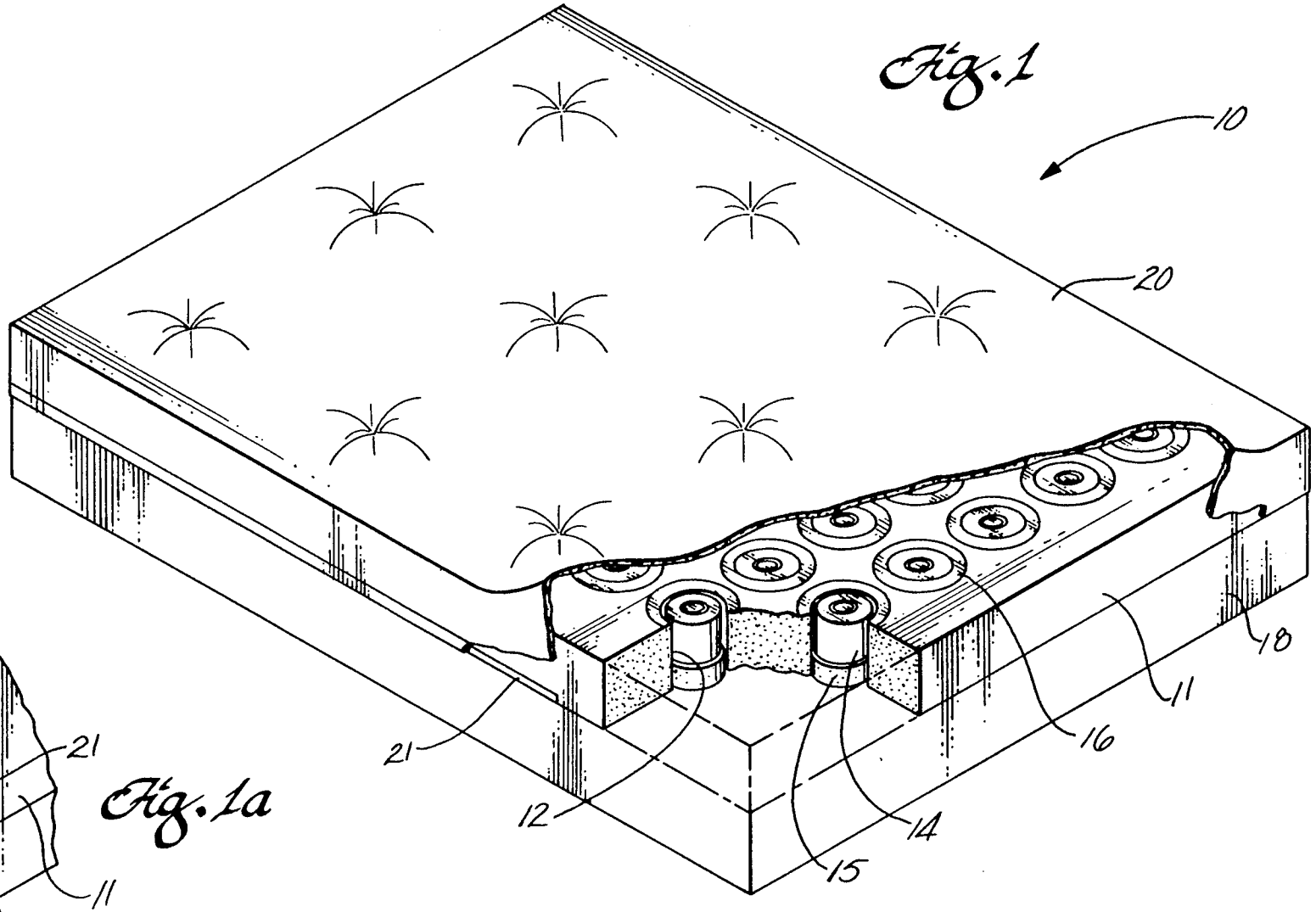
FIG. 1 is a perspective view, partially broken away, of a water bed mattress arrangement according to the principles of the invention.
Figure 1A:
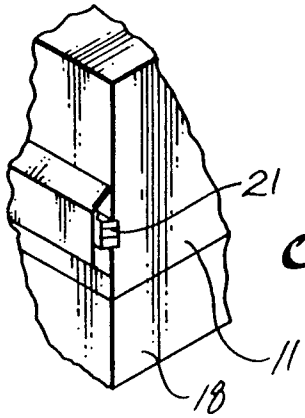
FIG. 1*a* is an enlarged fragmentary perspective view showing a means of attaching a tufted quilt to the mattress.

Referring to the drawings, FIG. 1 illustrates a water bed mattress 10 constructed in accordance with the principles of this invention. The mattress 10 comprises a rectangular thick sheet 11 of compressible plastic foam such as polyurethane foam. The polyurethane foam is fire retardant preferably with a 1.8 density and 32–36 softness. The foam sheet has a thickness that provides a useful level of sleeping support.

The foam sheet 11 has a number of cylindrical cutouts 12 dispersed substantially uniformly across the surface area of the sheet. The cutouts are preferably of uniform size (referring to the surface area within the plane of the foam sheet), and the cutouts are preferably arranged in a square matrix pattern spaced apart longitudinally and laterally across the surface area of the foam sheet. The cylindrical cutouts 12 each have a standard diameter of about eleven inches and a standard height of about six inches.

A zipper 21 is glued or bonded to the bottom periphery of the foam sheet 11. The foam sheet 11 covers the entire sleep surface of the mattress, therefore, eliminating the need for an upright outer retainer or side rails.

The foam sheet 11 is placed upon and is supported on the bottom by a base 18 which can be a conventional box spring or a bed frame platform. Covering the foam sheet 11 is a tufted quilt 20. The tufted quilt 20 has a thermal barrier preferably comprising Uniroyal Insulate material that reflects body heat back up to the tufted quilt surface. The use of this material in the quilt eliminates the need for a heater for the water contained in the bed. The tufted quilt cover 20 has a skirt and a zipper 21 at its periphery used to attach the quilt cover 20 to the foam sheet 11.

A separate water cushion 14 is freely disposed within each cutout 12, and in the embodiment of FIG. 2, a separate compressible cylindrical plastic foam disc 15 is disposed in the bottom of each cutout, below its corresponding water cushion.

Figure 2:
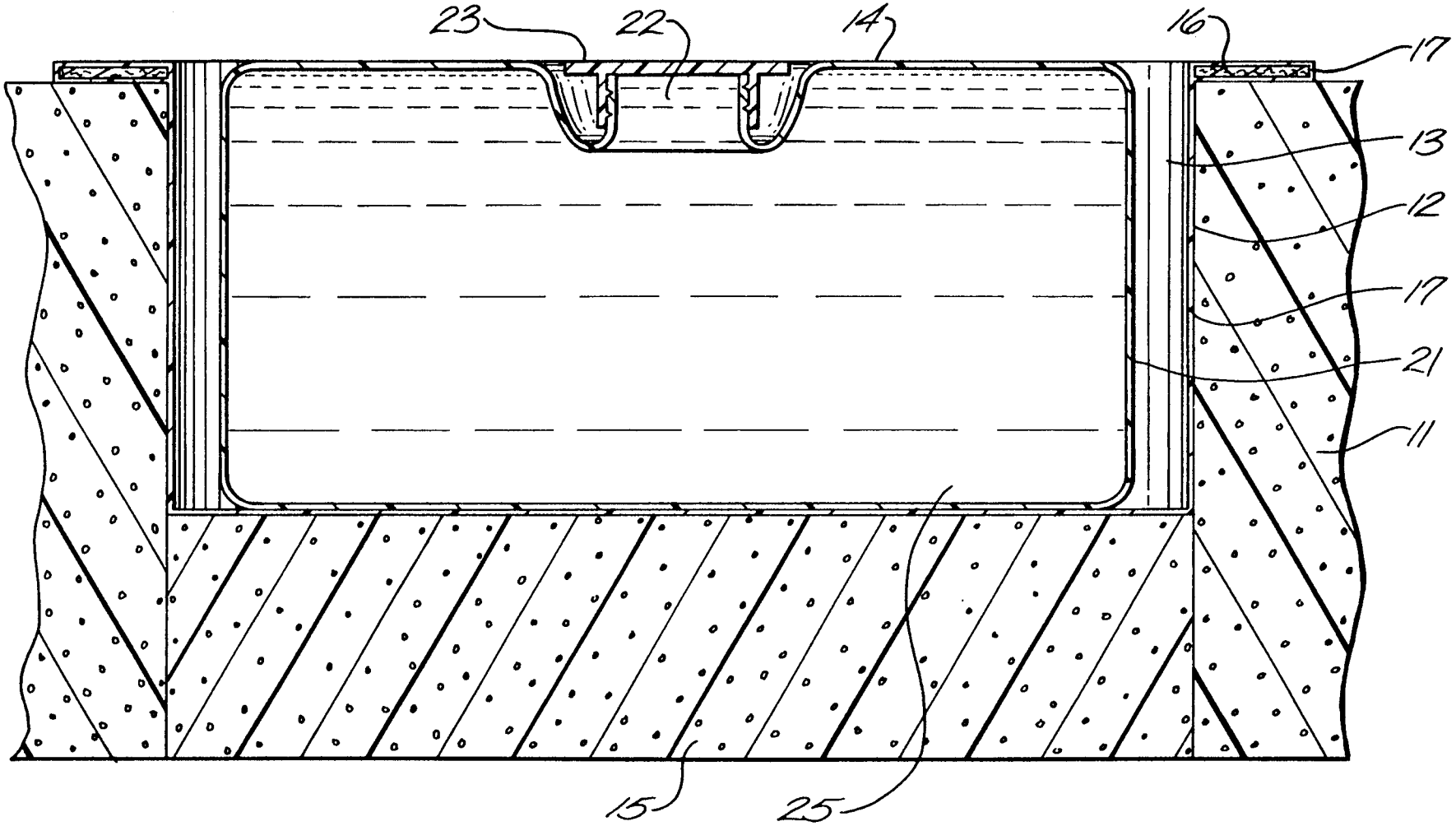
FIG. 2 is a cross-sectional view of a water cushion in a cylindrical cutout.
Figure 3:
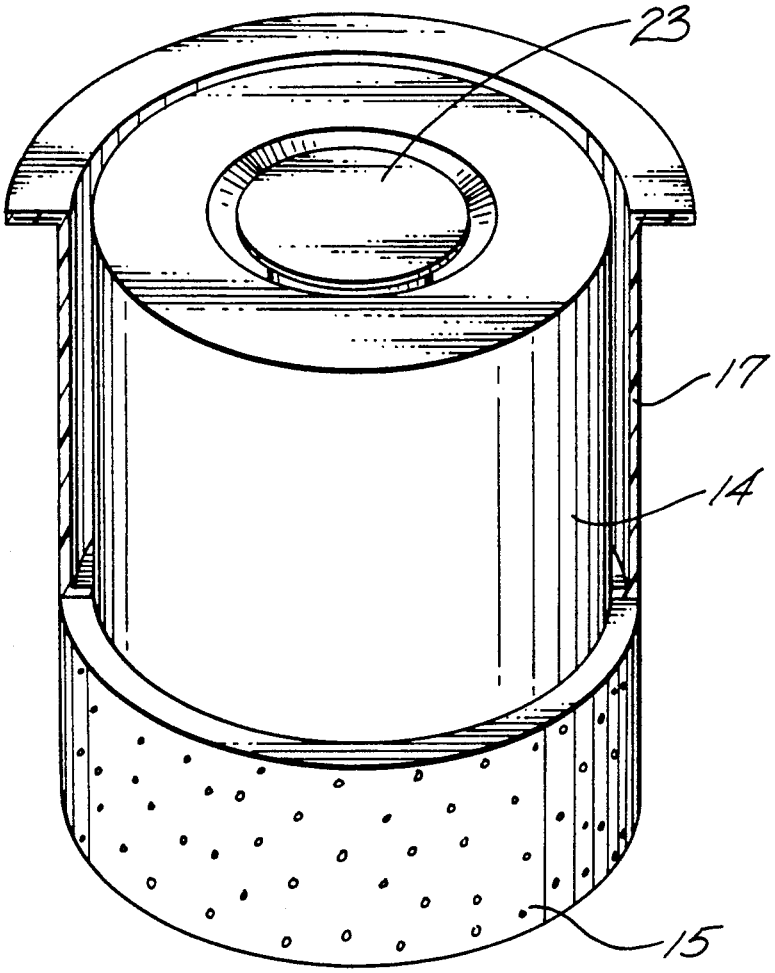
FIG. 3 is a perspective view, partly in cross section, of a water cushion, liner and foam insert shown in FIG. 2.

As can be seen in FIGS. 2 and 3, the foam disc 15 fills approximately the lower one-third of the volume within the cylindrical cutout 12. The foam disc 15 is made of the same material as the foam sheet 11.

The water cushion 14 comprises a hollow, flexible enclosure made of a cylindrical closed ended flexible plastic material 21 which is impervious to water. Water is contained within the hollow interior 25 of each flexible plastic enclosure. Each enclosure also has an opening 22 in its top for use in filling the enclosure with water. The opening is then sealed with a filler cap 23 which guards against leaks.

The water filled cushion 14 provides independent means of suspension or water support and is not attached to the cylindrical cutout 12. That is, each water cushion is freely placed in and removed from the cutouts in the foam mattress. There is a slight gap 13 between the water cushion 14 and the cylindrical cutout 12. This gap 13 allows the water cushion 14 to freely move within the cylindrical cutout 12 and conform to the body contours of the individual lying on the mattress and applying downward pressure to the water filled cushion. When pressure is applied downwardly on any of the water cushions, the sides of the flexible plastic enclosure spread outwardly into the adjacent foam pad and absorb the downward pressure. Each water cushion 14 works like an independent shock absorber.

In the embodiment of FIG. 2 the water cushion 14 occupies approximately the upper two-thirds of the volume within each cylindrical cutout 12. The flexible plastic material 21 of the water cushion 14 allows the user to fill each water cushion to its desired firmness. Since the cylindrical cutouts 12 and the water cushions 14 are uniformly spaced laterally and longitudinally across the foam sheet 11, the firmness of the water bed can be controlled from side-to-side and from top-to-bottom of the mattress. The more water the user places in a water cushion 14, the firmer the cushion (and the mattress) becomes.

Thus, the mattress provides an array of separate and independent areas of controllable water support combined with a compressible means of foam cushion support surrounding the water support areas to absorb and accommodate volumetric expansion of the individual areas of water support when different levels of downward pressure are applied anywhere across the sleeping surface. This arrangement also restricts wave action tending to act in both lateral and longitudinal directions along the sleeping surface.

A cardboard disc 16 has an inner diameter equal to the diameter of the cylindrical cutout 12. The cardboard disc 16 acts as a frame for a cylindrical cutout liner 17. The cylindrical cutout liner 17 is made of a flexible plastic material such as vinyl and is heat sealed to the vinyl adjacent the cardboard disc. The cylindrical cutout liner 17 extends into the cylindrical cutout 12 and acts as a reservoir should a water cushion 14 begin to leak. This liner 17 confines the leak to a small area, therefore making the clean up an easy task, while also eliminating the need to dismantle the entire bed to clean up the leak. Considering the numerosity of the water cushions, the user, if unable to replace or repair a leak in a water cushion immediately, can still continue to use the bed without noticing a missing water cushion.

Because of the size of the water cushions 14, the total weight of the water bed is reduced to approximately 35% that of a conventional water bed. Also, because of the size of the water cushions, the mattress is easier to set up or take down or move from room to room. Because of the spacing of the water cushions, the wave action is controlled from side to side as well as from top to bottom of the mattress. The intervening areas of compressible foam between the water cushions absorb wave action.

Figure 4:
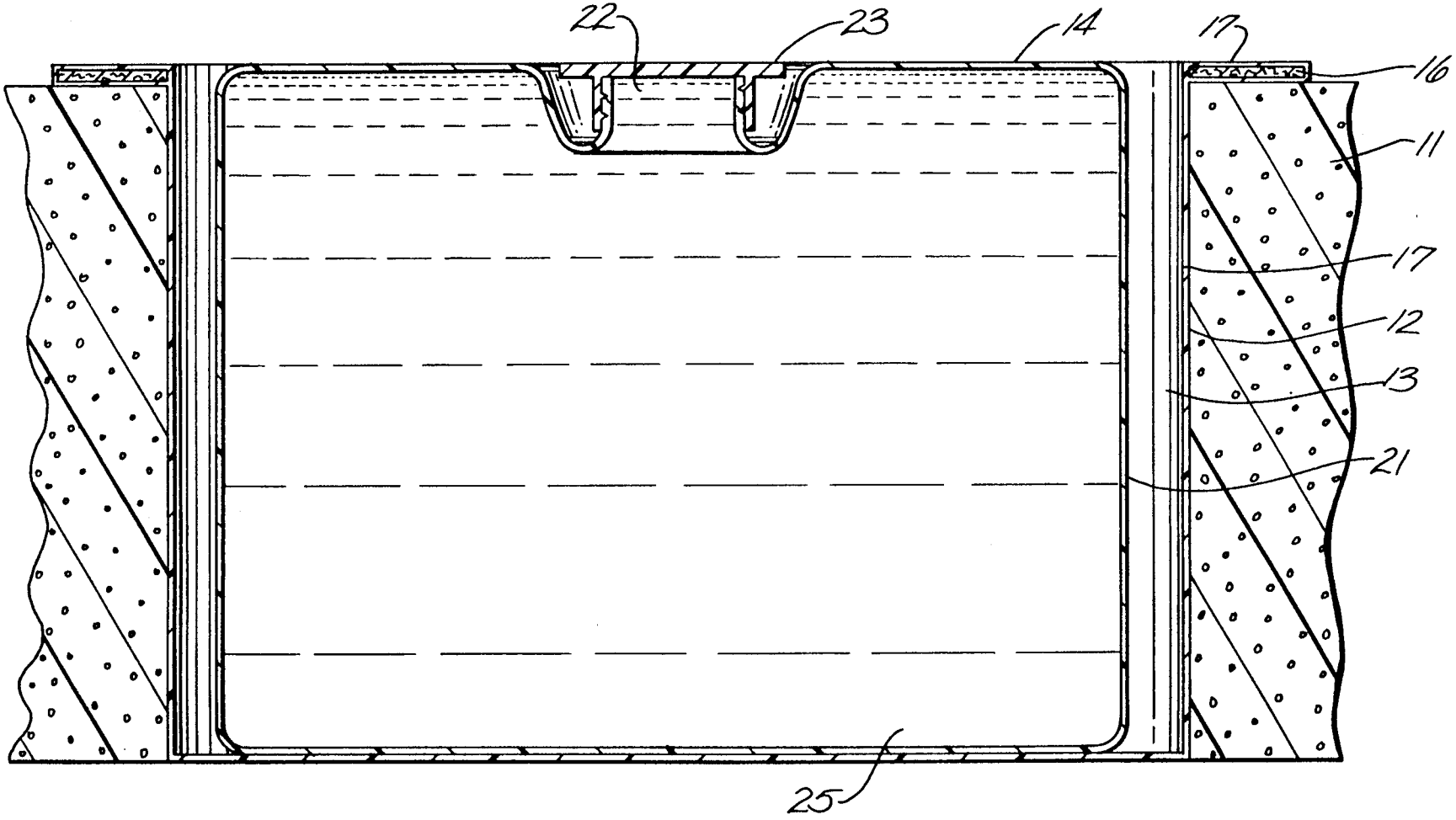
FIG. 4 is a cross-sectional view of an alternative embodiment of the water cushion and cylindrical cutout.

FIG. 4 illustrates an alternative embodiment of the present invention. In FIG. 4, the water cushion 14 fills the entire height of the cylindrical cutout 12. By eliminating the foam disc, the user can create a firmer mattress since the water cushion is now larger and allows the addition of more water. The cylindrical cutout liner 17 likewise fills the entire height of the cylindrical cutout 12.

Figure 5:
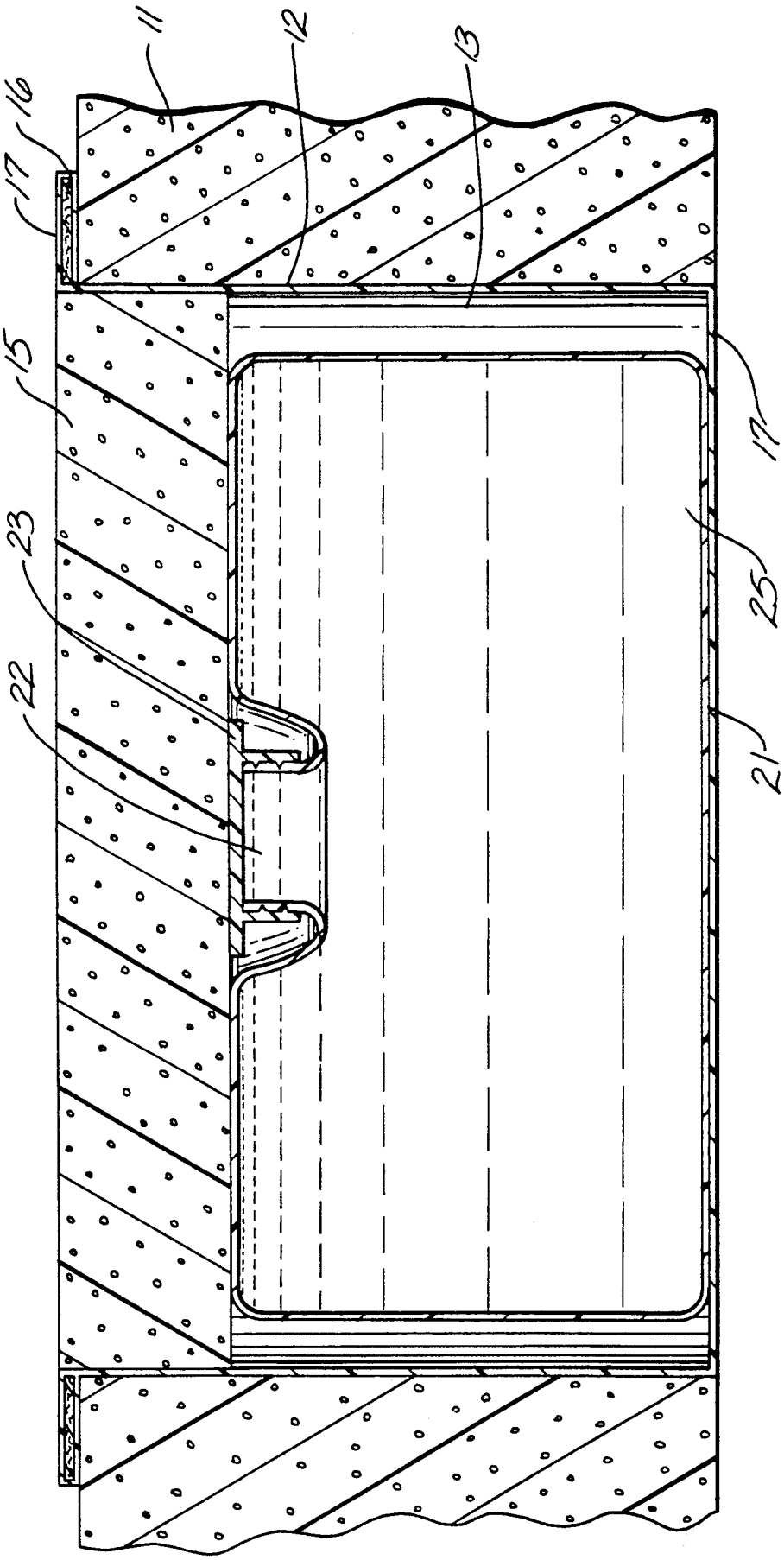
FIG. 5 is a cross-sectional view of a further alternative embodiment of the water cushion and cylindrical cutout.

FIG. 5 illustrates a second alternative embodiment of the present invention. In FIG. 5, the water cushion 14 is placed in the lower two-thirds of the cylindrical cutout 12. The foam disc 15 fills the upper one-third of the cylindrical cutout 12. By placing the foam disc 15 on top of the water cushion 14, it creates a dampening effect of the water and allows the individual to obtain less of a water bed feel.

Although the present invention has been described and is illustrated with respect to three embodiments thereof, it is to be understood that it is not to be so limited, since changes and modifications may be made therein which are within the full intended scope of this invention as hereinafter claimed.

What is claimed is:

1. A water bed mattress construction comprising:

a compressible sheet for providing a level of cushion-like sleeping support;

an array comprised of a plurality of cutout areas extending vertically into the depth of the compressible sheet and spaced apart laterally and longitudinally across the surface area of the compressible sheet; and a separate water cushion removably disposed within each cutout, each water cushion comprising a flexible water impervious enclosure with a hollow interior and a means for admitting water to the interior of the enclosure and sealing the water from the outside;

the mattress thereby providing an array of separate and independent areas of water support combined with a compressible means of cushion-like support surrounding each of the water support areas to absorb and accommodate volumetric expansion of the individual areas of water support when different degrees of downward pressure are applied randomly across the surface area of the mattress.

2. A water bed mattress according to claim 1 including;

a heat reflective cover removably mounted and covering the upper surface of said compressible sheet.

3. A water bed mattress according to claim 1, wherein each water cushion has an opening for filling the cushion with water and a cap for sealing the opening to the water cushion against leaks.

4. A water bed mattress according to claim 1 including a flexible ring having a size matching the outer shape of the cutout and located on an upper surface of the compressible sheet for surrounding the cutout, and a flexible water impervious liner sealed to the ring and having an open top for receiving the water cushion in the liner so the liner can protect the compressible sheet against leakage of water from the water cushion.

5. A water bed mattress according to claim 1 including a compressible cushion-like sheet formed as an insert to occupy a portion of the volume of the cutout adjacent the water cushion.

6. A water bed mattress according to claim 5, in which the water cushion is located underneath the compressible insert.

7. A water bed mattress according to claim 5 in which the insert is removable from each cutout.

8. A water bed mattress according to claim 1 in which the compressible sheet is a resilient foam sheet.

9. A water bed mattress according to claim 8 in which each cutout includes a compressible cushion-like sheet formed as an insert to occupy a portion of the volume of the cutout adjacent the water cushion.

10. A water bed according to claim 9 in which the compressible insert is a resilient foam sheet.

11. A water bed mattress construction comprising:

a compressible plastic foam sheet having an upper and lower surface and containing a plurality of substantially uniformly dispersed cutouts having a diameter and a height;

a water cushion located freely in each cutout, comprising a hollow flexible enclosure made of a cylindrical closed ended flexible water impervious material slightly smaller than the diameter of the cylindrical cutout;

a flexible ring having an inner diameter approximately equal to the diameter of said cutout and located on the upper surface of the compressible sheet and concentric with the cylindrical cutouts;

a cutout liner, covering and sealed to said ring, lining the height and diameter of said cutout; and a heat reflective cover removably covering the upper surface of said compressible sheet and its water cushions.

12. A water bed mattress construction comprising: a compressible foam sheet for providing a level of cushion-like sleeping support;

an array comprised of a plurality of cutout areas extending vertically into the depth of the compressible sheet and spaced apart laterally and longitudinally across the surface area of the compressible sheet; and a separate water cushion disposed within each cutout, each water cushion comprising a flexible water impervious enclosure with a hollow interior and a means for admitting water to the interior of the enclosure and sealing the water from the outside;

the mattress thereby providing an array of separate and independent areas of water support combined with a compressible means of cushion-like support surrounding each of the water support areas to absorb and accommodate volumetric expansion of the individual areas of water support when different degrees of downward pressure are applied randomly across the surface area of the mattress.

13. A water bed mattress according to claim 12 including a heat reflective cover removably mounted and covering the upper surface of said compressible sheet.

14. A water bed mattress according to claim 12 wherein each water cushion has an opening for filling the cushion with water and a cap for sealing the opening to the water cushion against leaks.

15. A water bed mattress according to claim 12 including a flexible ring having a size matching the outer shape of the cutout and located on an upper surface of the compressible sheet for surrounding the cutout, and a flexible water impervious liner sealed to the ring and having an open top for receiving the water cushion in the liner so the liner can protect the compressible sheet against leakage of water against the water cushion.

16. A water bed mattress according to claim 12 including a compressible cushion-like sheet formed as an insert to occupy a portion of the volume of the cutout adjacent the water cushion.

17. A water bed mattress according to claim 16 in which the water cushion is located underneath the compressible insert.

18. A water bed mattress according to claim 16 in which the insert is a resilient foam sheet.

* * * * *